US006261747B1

(12) United States Patent
Valvo et al.

(10) Patent No.: US 6,261,747 B1
(45) Date of Patent: Jul. 17, 2001

(54) BLACK-AND-WHITE SEPIA TONING KIT AND METHOD FOR ITS USE

(75) Inventors: David J. Valvo; Hugh G. McGuckin, both of Rochester; John S. Badger, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/576,728

(22) Filed: May 23, 2000

(51) Int. Cl.[7] ..... G03C 5/46
(52) U.S. Cl. ..... 430/370; 430/432
(58) Field of Search ..... 430/370

(56) References Cited

U.S. PATENT DOCUMENTS

| | | | | |
|---|---|---|---|---|
| 2,607,686 | | 8/1952 | Current | 430/370 |
| 3,515,555 | | 6/1970 | Fassbender | 430/370 |
| 3,928,040 | * | 12/1975 | Shimamura et al. | 430/430 |
| 4,609,616 | | 9/1986 | Frank | 430/430 |
| 4,816,384 | * | 3/1989 | Fruge et al. | 430/465 |
| 4,965,177 | | 10/1990 | McLaen | 430/405 |
| 5,037,727 | | 8/1991 | McLaen | 430/449 |
| 5,688,635 | | 11/1997 | Parker et al. | 430/464 |
| 5,728,511 | | 3/1998 | Hirosawa et al. | 430/356 |
| 5,851,720 | | 12/1998 | Shinohara | 430/201 |

FOREIGN PATENT DOCUMENTS 497481 12/1938 (GB) .

OTHER PUBLICATIONS

"The Professional Photographer", May 1980/37.

"Encyclopedia of Practical Photography" vol. 13, pp 2456–2464.

Leslie Stroebel, et al, "Photographic Materials and Processes", 1986, p. 330.

E.J. Wall, et al "Photographic Facts and Formulas", 1976, p. 360.

G. Haist, "Modern Photographic Processing", vol. 2, pp 94–96.

ST20—"Odourless Sepia Toner", date unknown—prior to Apr. 2000.

"Camera and DarkRoom", Toner Formula, Sep., 1995, 65.

BJP Annual 1968 p. 201.

"Toning Kodak Black–and–White Materials", G–23, Eastman Kodak Company, 1989.

* cited by examiner

*Primary Examiner*—Hoa Van Le
(74) *Attorney, Agent, or Firm*—J. Lanny Tucker

(57) ABSTRACT

A two-part sepia toning kit can be used to provide desired stable, warm sepia toned images in black-and-white photographic positive or negative materials such as black-and-white photographic prints. One part of the kit includes a silver bleaching composition comprising a hexacyanoferrate as the bleaching agent and halide ions in a molar ratio of at least 2.25:1. The second part is a toning composition that includes a sulfur-containing toning agent.

13 Claims, 2 Drawing Sheets

BLACK-AND-WHITE SEPIA TONING KIT AND METHOD FOR ITS USE

FIELD OF THE INVENTION

This invention relates to an improved sepia image toning kit and to a method for its use to modify the images in black-and-white photographic silver halide positive or negative materials.

BACKGROUND OF THE INVENTION

Black-and-white photographic prints or images are obtained generally by imagewise exposure of black-and-white photographic silver halide positive materials. The latent image is then processed using the appropriate photochemicals to provide the appropriate development of the silver and desilvering ("fixing") to remove unexposed silver.

Black-and-white photographic silver halide positive materials refers to those materials in which a positive black-and-white image can be obtained, including black-and-white reflective prints, black-and-white positive transparencies and black-and-white motion picture intermediate and print films. Negative materials refer to those materials in which a negative image is created that can then be used later to provide a positive viewing image. Such materials include black-and-white negative films and motion picture negative films.

"Toning" refers to a process wherein the normal neutral gray black-and-white image obtained in the conventional photochemical process to a stable form that is not oxidizable. In addition, the color of the image may be changed. In some toning processes, the metallic silver image obtained after development is converted to a silver sulfide image to produce what are commonly known as "sepia" prints that range in color from yellowish brown to a color approaching purple.

Sulfide toning methods may be either direct in which the silver image is converted at once into the silver sulfide image, or indirect in which two steps are required. Thus, the indirect method requires bleaching metallic silver to silver halide (such as silver bromide), and then converting the silver halide to silver sulfide.

One commonly used two-part sepia toning kit is available from Eastman Kodak Company as KODAK Sepia Toner Kit. The use of this kit provides rich, warm sepia images in many conventional imaged black-and-white photographic silver halide positive materials.

However, the color or tint of a sulfide-toned photographic material depends upon the sizes and structures of the silver halide grains used, as well as the compositions of those grains and the addenda used in modern black-and-white emulsions. In addition, the type of exposure and photographic processing (for example, the development step) of the imaged materials can have an effect on the eventual toned imaged. For example, compactness of the developed silver surface area or remaining emulsion addenda may promote an undesirable image.

Toned images may be identified as "cold" or "warm" depending upon where the toned image falls within the conventional CIE color scale using a* and b* values (Commission Internationale de l'Eclairage). A "cold" tone would be an image that is on the bluish side of neutral (that is negative b*), and a "warm" tone would be an image that is on the yellow or positive b* (and partly red or positive a*) side of neutral. Methods for obtaining "cold" toned images are described for example in U.S. Pat. No. 2,607,686 (Current), U.S. Pat. No. 5,037,727 (McLean) and U.S. Pat. No. 5,688,635 (Parker et al).

As black-and-white photographic silver halide positive materials have been redesigned in recent years, for example, to have different silver halide grain compositions and sizes, and other components have been added to the silver halide emulsions, the effect of conventional toning solutions has also changed. The conventional sepia toning compositions do not always provide the desired color shift, especially to the "warm" side of neutral. Moreover, the known toning compositions do not always provide the image stability that is desired. In other words, the black-and-white images may not be sufficiently stabilized using current toning products to provide long-term image quality (metallic silver could remain after toning that was not converted to a silver salt that may be susceptible to oxidation).

Thus, there is a need in the industry for an improved means for providing "warm" sepia toned images with a greater variety of silver halide photographic positive materials, and to provide images with improved stability.

SUMMARY OF THE INVENTION

The present invention provides an improved sepia toning kit comprising:

a) a silver bleaching composition comprising a hexacyanoferrate as a bleaching agent and halide ions, the molar ratio of hexacyanoferrate ions to halide ions being at least 2.25:1, and b) a toning composition comprising a sulfur toning agent.

This invention also provides a method of providing a warm sepia toned image comprising contacting an imagewise exposed, developed and fixed black-and-white photographic silver halide positive or negative material with aqueous solutions of compositions a) and b) described above, with washing between the two steps.

The sepia toning kit of this invention can be used to provide stabilized "warm" sepia tones in positive black-and-white prints or other black-and-white positive or negative photographic materials after they have been imagewise exposed, developed and fixed using conventional processing methods. The desired warm sepia color or tint is possible in a greater variety of photographic materials despite their increased silver halide emulsion complexity because of the modifications in the Part A silver bleaching composition. In addition, because more silver bromide is available for conversion to silver salt using the toning composition, image stability is improved so that image quality lasts much longer.

These advantages have been achieved by using a modified silver bleaching composition in the sepia toning method. In this silver bleaching composition, the molar ratio of the hexacyanoferrate bleaching agent to the halide ions has been increased significantly to at least 2.25:1.

In the practice of the present invention, it is desired to provide "warm" sepia tones as defined by the conventional CIE lab scale wherein both a* and b* values are considered. The a* value is a measure of redness (positive a* value) or greenness (negative a* value) of an image, and the b* value is a measure of blueness (negative b* value) or yellowness (positive b* value) of the image. In the art, a positive b* value is indicative of a "warm" image tone, but the a* value also should be positive also in order to provide a warm "sepia" (brownish) image tone.

It is a primary advantage of this invention that use of the sepia toning kit of this invention provides images in which at least the b* values are changed more than +0.1 on the standard a*b* color scale when measuring an image density of 0.8. Preferably both a* and b* values are independently changed at least +0.1, preferably at least +0.7 and more preferably at least +1.0, at an image density of 0.8. These changes are determined in relation to the conventional a* and b* values obtained by toning the same photographic black-and-white paper using the conventional KODAK Sepia Toner kit and conditions (see Kodak Technical Bulletin G-23, "Toning KODAK Black-and-White Materials", 1989, pages 11–12). This commercial toning kit has a Part A in which the hexacyanoferrate is present at 0.015 mol/l, and the molar ratio of hexacyanoferrate ions to bromide ions is about 0.36:1.

On an absolute scale, the present invention provides a sepia tone in the resulting image in, for example KODAK POLYMAX Fine Art F black-and-white paper, that has a b* value greater than 3 and preferably greater than 3.5, and an a* value greater than 2 and preferably greater than 2.5. The current KODAK Sepia Toner Kit would provide a b* value of 1 and an a* value of 1 in an image in the same paper.

DETAILED DESCRIPTION OF THE INVENTION

Figure 1:
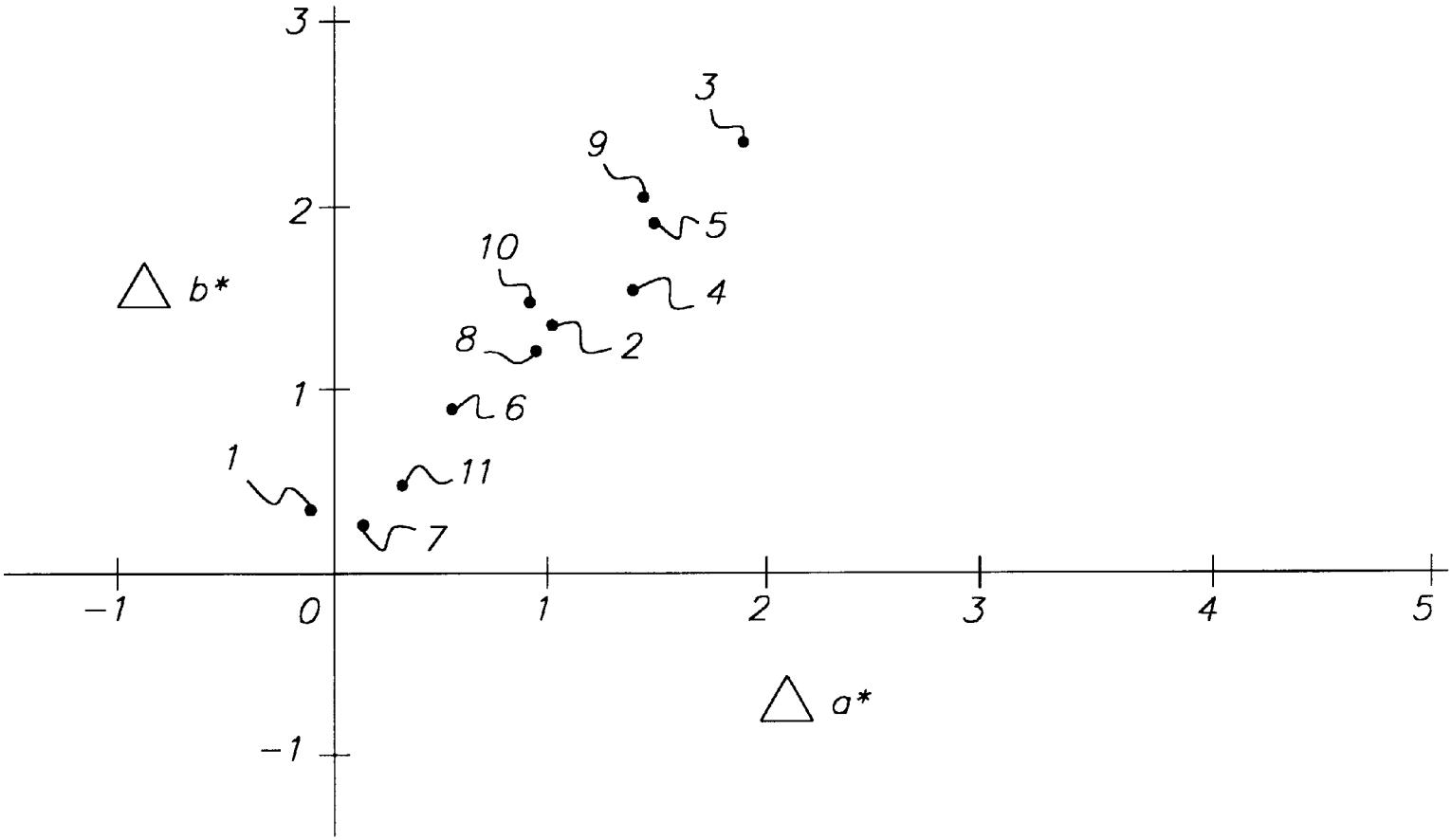
FIG. 1 is a graphical representation of a CIE lab a*b* color scale showing the differences in color values achieved using the preferred sepia toning kit of the present invention on various imaged black-and-white papers commercially available from Eastman Kodak Company. These data are described in more detail in Example 2 below.

The toning kit of this invention includes a minimum of two parts: a Part A silver bleaching composition including a silver bleaching agent and a halide salt, and a Part B toning composition containing a sulfur toning agent to react with silver halide formed using the bleaching composition to form silver sulfide in the toned image. Each part can be independently provided as aqueous solutions or in dry form (such as powders, tablets or granules). Preferably, each part is provided as a dry powder for improved storage stability.

The silver bleaching composition includes hexacyanoferrate ions [$Fe(CN)_6^{-3}$] or ferricyanide ions, as the silver bleaching agent. These ions may be complexed with suitable cations such as ammonium or alkali metal ions (for example, sodium or potassium ions). Alkali metal hexacyanoferrates such as potassium hexacyanoferrate (potassium ferricyanide) are most preferred. Mixtures of different hexacyanoferrate compounds can be used if desired.

In aqueous solutions, the concentration of the hexacyanoferrate ions in the Part A composition is generally at least 0.045 mol/l, and preferably at least 0.055 mol/l. The upper concentration can be generally 0.09 mol/l and preferably 0.082 mol/l. In the dry compositions, a skilled worker would readily know how to formulate the amount of hexacyanoferrate and halide ions based on the required molar ratio.

The silver bleaching composition is a rehalogenating bleaching composition and also includes a source of halide ions, such as an ammonium, alkali metal or alkaline earth salt (such as calcium or magnesium) of a halide (such as chloride, bromide or iodide). Preferably, the source of halide ions is sodium bromide, potassium bromide or magnesium bromide. Potassium bromide is most preferred in this composition. Mixtures of halide salts can be used if desired.

The hexacyanoferrate ions and halide ions are present in bleaching composition in a critical molar relationship. The molar ratio of hexacyanoferrate ions to halide ions is at least 2.25:1, and preferably it is at least 2.75:1. This molar ratio can generally be as large as 4.5:1 and preferably as large as 4:1. The optimum molar ratio within these ranges can be determined by routine experimentation and will depend upon the particular halide being used and the photographic material being processed. In contrast, the commercial KODAK Sepia Toner kit comprises a Part A silver bleaching composition comprising potassium hexacyanoferrate and potassium bromide in which the molar ratio of hexacyanoferrate to bromide ions is about 0.36:1.

The silver bleaching composition can also include addenda commonly present for various purposes other than sepia toning. For example, the composition may include one or more metal ion or calcium ion sequestering agents (such conventional polyphosphonates, polycarboxylates and polyaminopolycarboxylates), buffers and surfactants, in concentrations that would be readily apparent to one skilled in the art. If the bleaching composition is provided as an aqueous solution, its pH is generally from about 3 to about 8.

The Part B (or toning) composition useful in this invention comprises a source of sulfur (that is, a toning agent) that reacts with silver halide formed during the bleaching step to form silver sulfide. Preferably such toning agents are inorganic compounds. Useful toning agents are well known in the art and include, but are not limited to, alkali metal sulfides (such as sodium sulfide and potassium sulfide), thiourea (and derivatives thereof such as alkyl thioureas, acetyl thiourea, thioacetamide and thioacetanilide) or mixtures of any of these compounds. The alkali metal sulfides are preferred and sodium sulfide is most preferred.

The source of sulfur is generally present in the Part B composition in an amount (in aqueous solutions, usually as sulfide ion) of at least 0.006 mol/l and preferably at least 0.025 mol/l. The upper limit can vary depending upon the specific compound(s) used and generally 0.02 mol/l and preferably 0.01 mol/l.

The toning composition can also include addenda such as hydroxides, buffers, metal or calcium ion sequestering agents, or surfactants in amounts that would be readily apparent to one skilled in the art. If provided as an aqueous solution, the toning composition generally has a pH of from about 7 to about 13.

The black-and-white photographic materials processed using the present invention include any silver halide material that can be used to provide a positive or negative, toned black-and-white image. Such materials include consumer and professional black-and-white photographic papers, consumer and professional black-and-white negative films, positive transparency materials, motion picture negative, print and intermediate films and silver halide diffusion transfer print materials.

The processed materials can have any suitable silver halide emulsion known for this purpose, the details of which are described *Research Disclosure,* publication 38957 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011).

The silver halide emulsion layers comprise one or more types of silver halide grains responsive to suitable electromagnetic radiation (including UV, visible and infrared radiation). Such emulsions include silver halide grains composed of, for example, silver bromide, silver chloride silver iodobromide, silver chlorobromide, silver iodochlorobromide, and silver chloroiodobromide. Iodide is generally limited to no more than 5 mol% (based on total silver) to facilitate more rapid processing. Preferably iodide is limited to no more than 2 mol% (based on total silver) or eliminated entirely from the grains. Silver chloride may comprise at least 40 mol% of the silver halide in some emulsions. The silver halide grains in each silver halide emulsion unit (or silver halide emulsion layers) can be the same or different, or mixtures of different types of grains.

The silver halide grains useful in the processed photographic materials can have any desirable morphology including, but not limited to, cubic, octahedral, tetradecahedral, rounded, spherical or tabular morphologies, or be comprised of a mixture of two or more of such morphologies.

A variety of silver halide dopants can be used, individually and in combination, to improve contrast as well as other common properties, such as speed and reciprocity characteristics. A summary of conventional dopants to improve speed, reciprocity and other imaging characteristics is provided by *Research Disclosure,* Item 38957, cited above, Section I. Emulsion grains and their preparation, sub-section D. Grain modifying conditions and adjustments, paragraphs (3), (4) and (5).

A general discussion of silver halide emulsions an their preparation is provided by *Research Disclosure,* Item 38957, cited above, Section I. Emulsion grains and their preparation. After precipitation and before chemical sensitization the emulsions can be washed by any convenient conventional technique using techniques disclosed by *Research Disclosure*, Item 38957, cited above, Section III. Emulsion washing.

The emulsions can be chemically sensitized by any convenient conventional technique as illustrated by *Research Disclosure*, Item 38957, Section IV. Chemical Sensitization: Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by *Research Disclosure,* Item 38957, Section VII. Antifoggants and stabilizers, and Item 18431, Section II: Emulsion Stabilizers, Antifoggants and Antikinking Agents.

The silver halide emulsion layers and other hydrophilic layers on both sides of the support of the photographic material generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure,* Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin. Both hydrophobic and hydrophilic synthetic polymeric vehicles can be used also. Such materials include, but are not limited to, polyacrylates (including polymethacrylates), polystyrenes and polyacrylamides (including polymethacrylamides).

The silver halide emulsion layers (and other hydrophilic layers) in the photographic materials can be partially or fully hardened using one or more conventional hardeners.

The photographic materials can include a surface protective overcoat over the emulsion layer(s). Each protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by *Research Disclosure,* Item 38957, Section IX. Coating physical property modifying addenda, A. Coating aids, B. Plasticizers and lubricants, C. Antistats, and D. Matting agents.

Examples of commercial positive photographic materials that can be processed using the present invention include, but are not limited to, KODAK POLYMAX II RC Black and White Papers, KODAK KODABROME II RC F Black and White Paper, KODAK PMAX Art RC V Black and White Paper, KODAK POLYCONTRAST III RC Black and White Paper, KODAK PANALURE Select RC Black and White Paper, KODAK POLYMAX FINE ART Black and White Papers, KODAK AZO Black and White Papers, ILFORD MULTIGRADE IV RC and FB Black and White Papers, ILFORD ILFOBROME GALARIE Black and White Papers, and AGFA MULTICONTRAST CLASSIC and PREMIUM Black and White Papers.

After imagewise exposure, the black-and-white photographic positive or negative materials are generally processed using at least conventional black-and-white developing and fixing compositions using conventional conditions and processing times. Such compositions are well known in the art and a number of them are commercially available from Eastman Kodak Company as KODAK DEKTOL Developer (usually diluted 1:2 with water for use) and KODAK RAPID Fix part A (usually diluted 1:7 for use). The use of a hardener (such as KODAK Rapid Fix Part B) is not recommended prior to toning.

Processing can be carried out using conventional non-metallic tanks, trays and automated processing machines holding processing solutions. Alternatively, it can be carried out using what is known in the art as "low volume thin tank" processing systems using either a non-metallic rack and tank or automatic tray designs. Such processing methods and equipment are described, for example, in U.S. Pat. No. 5,436,118 (Carli et al) and publications cited therein.

Once the desired black-and-white positive or negative image has been obtained, the photographic images are subjected to bleaching and toning using the toning kit of this invention to provide the desired warm sepia toned positive or negative images.

In a silver bleaching step, the bleaching composition described herein is mixed in water either in dry form or as a concentrate and diluted appropriately. In most instances, the dry composition is mixed in water and used without any dilution The imaged material is contacted with aqueous bleaching solution for at least 5 seconds and up to 20 minutes (preferably from about 6 to about 10 minutes) at a temperature of from about 15 to about 25° C. until a satisfactory image is obtained.

With or without drying, the bleached image is then contacted with the toning composition described herein in a toning step. It has been mixed in water either in dry form or as a concentrate and diluted appropriately, or used without dilution. The bleached material is contacted with the working strength toning solution for at least 25 seconds and up to 60 seconds (preferably from about 30 to about 45 seconds) at a temperature of from about 15 to about 25° C.

In preferred methods, a water-washing step is used between the bleaching and toning steps. The washing solution can include buffers or surfactants if desired.

The following examples are provided to illustrate the practice of the present invention, including the best mode, but they are not meant to be limiting in any way.

EXAMPLE 1

Preferred Sepia Toning Kit

The two compositions of a preferred sepia toning kit of this invention were mixed in water and comprised the following components:

| | |
|---|---|
| Part A: | |
| Potassium hexacyanoferrate | 0.0609 mol/l |
| Potassium bromide | 0.0197 mol/l |
| The molar ratio of hexacyanoferrate ions to bromide ions was about 3.09:1. | |
| Part B: | |
| Sodium sulfide | 0.05 mol/l |

EXAMPLE 2

Method of Toning Black-and White Photographic Papers

The sepia toning kit described in Example 1 was used to provide warm sepia toned images in several black-and-white photographic papers that are commercially available from Eastman Kodak Company.

Samples of these black-and-white papers black-and-white photographic papers were imagewise exposed and processed using KODAK DEKTOL Developer (diluted 1:2) and KODAK Rapid Fix Part A (diluted 1:7) to provide desired black-and-white images. These imaged materials were then washed with water for several minutes at 18–21° C. and treated with the Parts A and B of the sepia toning kit of Example 1 using the following protocol:

Bleaching Step

Contact with Part A for 6–8 minutes at 18.5–21° C.

Water Washing Step

Contact with water for about 2 minutes at 18.5–21° C.

Toning Step

Contact with Part B for about 60 seconds at 18.5–21° C.

Further rinsing with water for 30 seconds can also be carried out, and the toned materials can be immersed in a conventional hardening bath for 2–5 minutes at room temperature. The hardening bath was prepared by mixing 13 parts of water with 1 part of KODAK Liquid Hardener. Fiber-based prints were washed for 30 minutes in water at 18.5–21° C., and resin-based prints were washed for 4 minutes in water at the same temperature.

FIG. 1 shows the Δ (delta) or the difference between the use of the conventional KODAK Sepia Toner kit and the toner kit of this invention in a* and b* values for the toned images in the various papers that are identified as follows:

| Datum Point | Black-and-White Paper Sample |
|---|---|
| 1 | KODAK AZO B&W Paper |
| 2 | KODAK POLYMAX Fiber F B&W Paper |
| 3 | KODAK POLYMAX Fine Art F B&W Paper |
| 4 | KODAK POLYMAX Fine Art C B&W Paper |
| 5 | KODAK KODABROME II RC F |
| 6 | KODAK PMAX Art V B&W Paper |
| 7 | KODAK POLYCONTRAST III F B&W Paper |
| 8 | KODAK POLYCONTRAST III F + BT B&W Paper |
| 9 | KODAK POLYMAX II F B&W Paper |
| 10 | KODAK POLYMAX II RC (warm tone) B&W Paper |
| 11 | KODAK PANALURE Select B&W Paper |

In FIG. 1, the Δa* and Δb* values are measured in relation to the a* and b* obtained using the same images, chemical processing and toning using the convention Kodak Sepia Toner Kit (Part A and B composition shown below). Thus, tones obtained using the conventional toner kit would be considered as having a* and b* values of 0,0 respectively on FIG. 1. It is apparent that practice of the present invention provided a change in these values of at least +0.1 for the *b values, and in most cases, for both a* and b* values. All but three paper samples provided toned images with greater than +0.7 change in both a* and b* values, and several papers provided toned images with a greater than +1.0 change in both *a and *b values.

| | |
|---|---|
| Part A (Conventional kit): | |
| Potassium hexacyanoferrate | 0.0146 mol/l |
| Potassium bromide | 0.0403 mol/l |
| The molar ratio of hexacyanoferrate ions to bromide ions was about 0.36:1. | |
| Part B (Conventional kit): | |
| Same as above | |

EXAMPLE 3

Method of Toning Additional Commercially Available Papers

Figure 2:
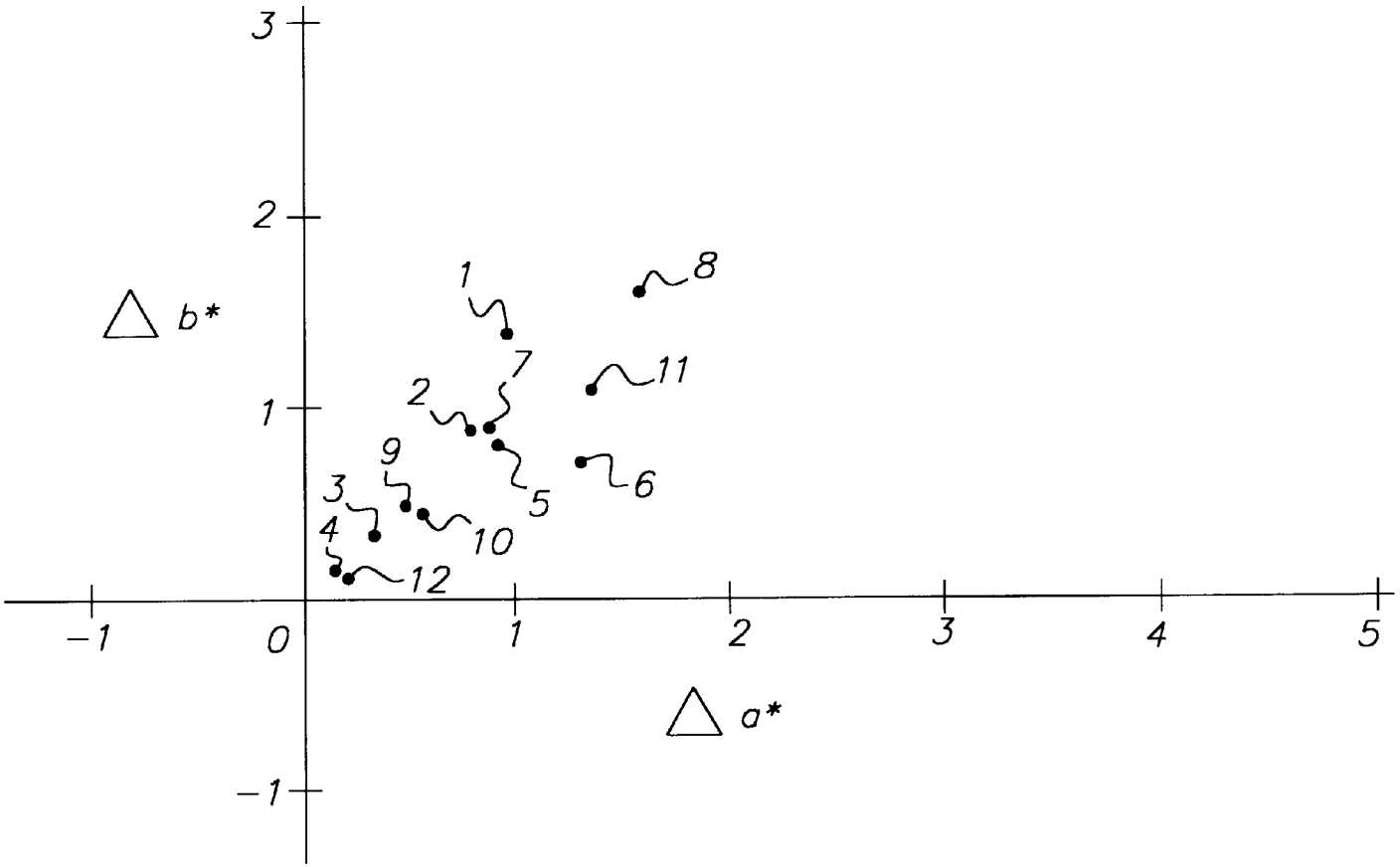
FIG. 2 is a graphical representation of a CIE lab a*b* color scale showing the differences in color values achieved using the preferred sepia toning kit of the present invention on various imaged black-and-white papers commercially available from companies other than Eastman Kodak Company. These data are described in more detail in Example 3 below.

Example 2 was repeated to tone various commercially available black-and-white papers from several sources other than Eastman Kodak Company. FIG. 2 identifies the changes in a* and b* color values for the various papers identified below.

| Datum Point | Black-and-White Paper Sample |
|---|---|
| 1 | ILFORD MULTIGRADE B&W Paper |
| 2 | ILFORD ILFOBROME GALLARY B&W Paper |
| 3 | AGFA MULTICONTRAST CLASSIC FB B&W Paper |
| 4 | AGFA PORTRIGA B&W Paper |
| 5 | ILFORD MULTIGRADE IV RC B&W Paper |
| 6 | ILFORD MULTIGRADE RC WARMTONE B&W Paper |
| 7 | ILFORD MULTIGRADE RC III PORTFOLIO B&W Paper |
| 8 | ILFORD MULTIGRADE RC III RAPID B&W Paper |
| 9 | AGFA MULTICONTRAST PREMIUM B&W Paper |
| 10 | AGFA BOVIA SPEED B&W Paper |
| 11 | FORTE POLYGRADE RC B&W Paper |
| 12 | FORTE POLYWARMTONE RC B&W Paper |

The invention has been described in detail with particular reference to certain preferred embodiments thereof, but it will be understood that variations and modifications effected within the spirit and scope of the invention.

We claim:

1. A sepia toning kit comprising:

a) a silver bleaching composition having a pH of from about 3 to about 8 when in aqueous form, and comprising at least 0.045 mol/l of a hexacyanoferrate as a bleaching agent and halide ions, the molar ratio of hexacyanoferrate ions to halide ions being from about 2.75:1 to about 4:1, and b) a toning composition having a pH of from about 7 to about 13 when in an aqueous form, and comprising at least 0.006 mol/l of a sulfur toning agent.

2. The toning kit of claim 1 wherein said hexacyanoferrate is an alkali metal hexacyanoferrate.

3. The toning kit of claim 2 wherein said hexacyanoferrate is potassium hexacyanoferrate.

4. The toning kit of claim 1 wherein said halide ions are provided as an alkali metal salt.

5. The toning kit of claim 1 wherein said halide ions are provided as potassium bromide.

6. The toning kit of claim 1 wherein said bleaching and toning compositions are provided as dry powders.

7. The toning kit of claim 1 wherein said toning composition comprises an alkali metal sulfide as the toning agent.

8. The toning kit of claim 7 wherein said toning composition comprises potassium sulfide as the toning agent.

9. A method of providing a warm sepia toned image comprising:

A) contacting an imagewise exposed, developed and fixed black-and-white photographic silver halide positive or negative material with an aqueous sepia silver bleaching composition having a pH of from about 3 to about 8 and comprising at least 0.045 mol/l of a hexacyanoferrate as a bleaching agent and halide ions, the molar ratio of hexacyanoferrate ions to halide ions being from about 2.75: 1 to about 4:1, and B) after washing said positive or negative material, contacting said material with an aqueous toning composition having a pH of from about 7 to about 13 comprising at least 0.006 mol/l of a sulfur toning agent.

10. The method of claim 9 wherein the resulting toned image in said material has a b* value greater than 3.

11. The method of claim 9 wherein the resulting toned image in said material has a $\Delta a^*$ and $\Delta b^*$ independently at least 0.1 compared to the a* and b* values at an image density of 0.8 obtained by toning said imaged material using a silver bleaching composition comprising at least 0.015 mol/l of a hexacyanoferrate as a bleaching agent and halide ions, the molar ratio of hexacyanoferrate ions to halide ions being at least 0.36:1, and same toning composition.

12. The method of claim 10 wherein the resulting toned image in said material has an a* value greater than 2 and a b* values independently greater than 3.

13. The method of claim 9 wherein said black-and-white photographic silver halide material is a photographic paper.

* * * * *